US010308473B2

(12) United States Patent
Balzanelli

(10) Patent No.: US 10,308,473 B2
(45) Date of Patent: Jun. 4, 2019

(54) AUTOMATICALLY COILING PIPES IN SPOOL FORM WITH A CONSTANT INTERNAL PRESSURE

(71) Applicant: F.B. Balzanelli S.r.l., Milan (IT)

(72) Inventor: Alessandro Balzanelli, Milan (IT)

(73) Assignee: F.B. Balzanelli S.r.l., Milan (IT)

( * ) Notice: Subject to any disclaimer, the term of this patent is extended or adjusted under 35 U.S.C. 154(b) by 547 days.

(21) Appl. No.: 15/015,963

(22) Filed: Feb. 4, 2016

(65) Prior Publication Data

US 2016/0229658 A1 Aug. 11, 2016

(30) Foreign Application Priority Data

Feb. 5, 2015 (IT) ..... MI2015A0156

(51) Int. Cl.

| | |
|---|---|
| ***B23K 20/10*** | (2006.01) |
| ***B65H 61/00*** | (2006.01) |
| ***B65H 54/58*** | (2006.01) |
| ***B65H 54/62*** | (2006.01) |
| ***B65H 54/71*** | (2006.01) |
| ***B65H 63/08*** | (2006.01) |

(52) U.S. Cl.

CPC ..... *B65H 61/00* (2013.01); *B65H 54/58* (2013.01); *B65H 54/62* (2013.01); *B65H 54/71* (2013.01); *B65H 63/082* (2013.01); *B65H 2701/33* (2013.01)

(58) Field of Classification Search

CPC ..... B23K 20/10; B23K 20/106

See application file for complete search history.

(56) References Cited

U.S. PATENT DOCUMENTS 2,275,157 A * 3/1942 Morgan ..... B65D 3/04 156/190

FOREIGN PATENT DOCUMENTS

| | | |
|---|---|---|
| EP | 2628576 A1 | 8/2013 |
| EP | 2799382 A1 | 11/2014 |
| JP | H10238976 A | 9/1998 |

OTHER PUBLICATIONS

Written Opinion issued in Italian Application No. MI2015A000156 dated Sep. 25, 2015.

* cited by examiner

*Primary Examiner* — Erin B Saad

(74) *Attorney, Agent, or Firm* — Mintz Levin Cohn Ferris Glovksy and Popeo, P.C.

(57) ABSTRACT

A machine for coiling pipes (1) in spool form, includes a structure (10) supporting a rotating reel (11), a feeder unit for feeding a pipe (1) to the reel (11) in a longitudinal direction (X-X), a device (12) for cutting the pipe (1), a measuring unit (20) for measuring the length of the pipe (1), arranged upstream of the cutting device (12), in the longitudinal direction (X-X). The machine includes a device for hermetically sealing the pipe arranged in a zone of the machine situated upstream in the direction of feeding of the pipe towards the reel of the means for fastening to the reel and upstream of the cutting device in the same direction of feeding.

14 Claims, 2 Drawing Sheets

AUTOMATICALLY COILING PIPES IN SPOOL FORM WITH A CONSTANT INTERNAL PRESSURE

RELATED APPLICATIONS

This application claims priority under 35 U.S.C. § 119 to Italian patent application number MI2015A000156 filed on Feb. 5, 2015, the entire contents of which is hereby incorporated by reference herein.

TECHNICAL FIELD

The present subject matter relates to automatically coiling pipes under pressure onto a spool and to a pipe-coiling machine.

BACKGROUND

It is known, in the technical sector relating to the coiling of pipes, hanks, and the like into spools, that spools are obtained by coiling the hank onto a reel rotating on a motor-driven hub of a coiling machine. Different models of coilers can automatically coil pipes made of plastic and other materials. The coilers can operate with a completely automatic cycle that includes: (1) extruding the pipe fed in a continuous cycle to a coiling machine; (2) automatically fastening the pipe to be coiled onto the reel by means of a corresponding mechanical device; (3) automatically starting the coiling step, during which a second pipe-guiding device distributes the pipe on the rotating reel; (4) automatically cutting the pipe when the set coiling length is reached; (5) once the spool has been packaged, automatically unloading the roll produced, which is in the form of a pipe that is perfectly coiled to the desired length ready for palletizing operations.

A particular example of such production cycles includes pipes—such as Pex-a pipes used for heating floor panels—for which a high product quality and uniformity of thickness is required.

For this purpose various production methods have been developed, one of these envisaging the use of a constant-pressure air jet supplied inside the pipe which, in order to maintain the required internal pressure, has its free end closed during extrusion and fastening of the pipe to the reel for performing coiling in spool form.

One of the methods for production of such pipes envisages the manual sequences of: (1) manually fitting a cap onto the free end of the pipe as soon as it emerges formed from the extrusion station; (2) manually conveying inside the reel the capped front free end—referred to below as "head end"—and fastening thereof; (3) formation of the spool, by coiling the programmed number of meters of pipe; and (4) cutting the wound pipe.

EP 2,799,382 describes a machine, in which sealing is performed by means of insertion, along the production line, of a pipe-closing cap. During the cutting step, however, it can be necessary for the new head end of the pipe being fed from the extrusion station to be closed in order to maintain the internal pressure. Preliminary crushing of the pipe can be performed upstream of the cutting zone in order to sealingly close the new free end prior to cutting thereof. Once the cut has been performed, a cap is manually fitted onto the new head end of the pipe. Once the reel has completed coiling of the spool with subsequent packaging and unloading thereof, renewed fastening of the new head end of the formed pipe is performed, again manually.

This method, however, involves significant drawbacks, mainly arising from the need to interrupt the continuous coiling cycle with a plurality of manual operations, which result in substantial increases in the machine downtime, with the production efficiency depending to a large extent on the experience and the skill of the operator responsible for performing the cuts and fitting the caps.

SUMMARY

The technical problem posed is that of developing a method and an apparatus for coiling pipes in spool form and of the type to be kept under a generally constant, predefined, internal pressure during the entire production cycle so as to solve the problems of the prior art mentioned above and which is more automated in nature.

Apparatus embodiments may have small dimensions, be easy and inexpensive to produce and assemble and be able to be easily installed at any user location, including on already existing machines, using conventional standardized means.

In an aspect, these results are obtained according to the present subject matter by a machine for coiling and packaging spools of pipes. Some embodiments of the machine include a structure and a sealing gripper, with the structure supporting a rotating reel, a feeder, at least one cutting device, and a measuring unit. The feeder feeds a pipe to the reel in a longitudinal direction. The at least one cutting device is for cutting the pipe. The measuring unit is for measuring a length of the pipe. The measuring unit is arranged upstream of the at least one cutting device in the longitudinal direction. The sealing gripper is for hermetically sealing the pipe. The sealing gripper is in a zone situated upstream in the direction of feeding of the pipe towards the reel and upstream of the at least one cutting device in the same direction of feeding. The sealing gripper crushes and welds the head end of the pipe.

One or more of the following features can be included in any feasible combination. For example, the sealing gripper device for hermetically sealing the pipe can be arranged in a zone of the machine situated upstream, in the direction of feeding of the pipe towards the reel, of the means for fastening to the reel, and upstream of the at least one cutting device in the same direction of feeding. The sealing gripper can include a fixed jaw and a movable jaw moved by an actuator of the pneumatic or electromechanical type. The sealing gripper can include an ultrasound welder. The movable jaw can have, formed inside it, a duct for transmission of ultrasounds, which are generated by an ultrasound generator, and the ultrasounds reach the crushed pipe for sealing. A control and command device can be included connected to a transducer for detecting signals emitted by sensors and controlling operation of moving parts. The measuring unit for measuring the length of the pipe can include at least one meter-counting device for measuring the length of the pipe fed to the reel in the longitudinal direction and for emitting an end-of-measurement signal. The meter-counting device can send the end-of-measurement signal to a control and command device when a predetermined number of measured meters is reached.

In another aspect, these results may be obtained according to the present subject matter by a method for coiling and packaging spools of pipes with a predefined internal pressure and fed in a longitudinal direction from an extruder to a coiling machine equipped with a reel, a sealing unit, and at least one cutting device. Method embodiments include preparing a pipe section with a sealed head end and extruded with a predefined internal pressure. The sealed head end of the extruded pipe section is fed under pressure to the coiling machine with fastening of the head end onto the reel. Coiling of the fastened pipe is started. Coiling is stopped when a desired length of pipe to be coiled is reached. The tail end of the pipe being coiled is hermetically sealed. The pipe is cut downstream in the longitudinal direction of feeding of the hermetic sealing station with formation of new sealed head end of a new pipe section extruded under pressure. The spool being coiled is completed, packaged and unloaded. The new hermetically sealed head end is automatically conveyed to the reel for fastening and starting coiling of a new spool. The coiling cycle is restarted. Sealing of the pipe includes a crushing step and a step for welding the crushed edges of the pipe.

One or more of the following features can be included in any feasible combination. Preparing the pipe section can include feeding a first open pipe section extruded without internal pressure to the sealing unit; sealing the head end of the first pipe section not under pressure; advancing the sealed pipe by an amount at least equal to the length of sealed pipe section situated between the extruder and the sealing unit; hermetically sealing the pipe section with sealed head end, following said advancing operation; and cutting the sealed extruded pipe downstream, in the longitudinal direction of feeding, of the hermetic sealing station, with formation of a pipe section having a sealed head end and extruded with a predefined internal pressure.

The predefined internal pressure can be a constant pressure. The welding step can be an ultrasound welding step. The measurements of the pipe sections to be sealed and cut can be determined by a measuring unit arranged between the extruder and the sealing gripper. The measuring of the pipe section to be coiled can include start counting by a meter-counting device for counting meters of pipe fed; emission by the meter-counting device of a signal when a predefined number of meters corresponding to the predefined length of pipe to be coiled is reached; sending of the signal indicating the length has been reached to a control unit; and defining a time interval calculated from the moment of emission of the signal by the meter-counting device and determined on the basis of a distance between the measuring unit and a cutting blade and a speed of feeding of the pipe.

DESCRIPTION OF THE DRAWINGS

Further details may be obtained from the following description of a non-limiting example of embodiment of the subject of the present subject matter, provided with reference to the accompanying drawings, in which.

DETAILED DESCRIPTION

Figure 1:
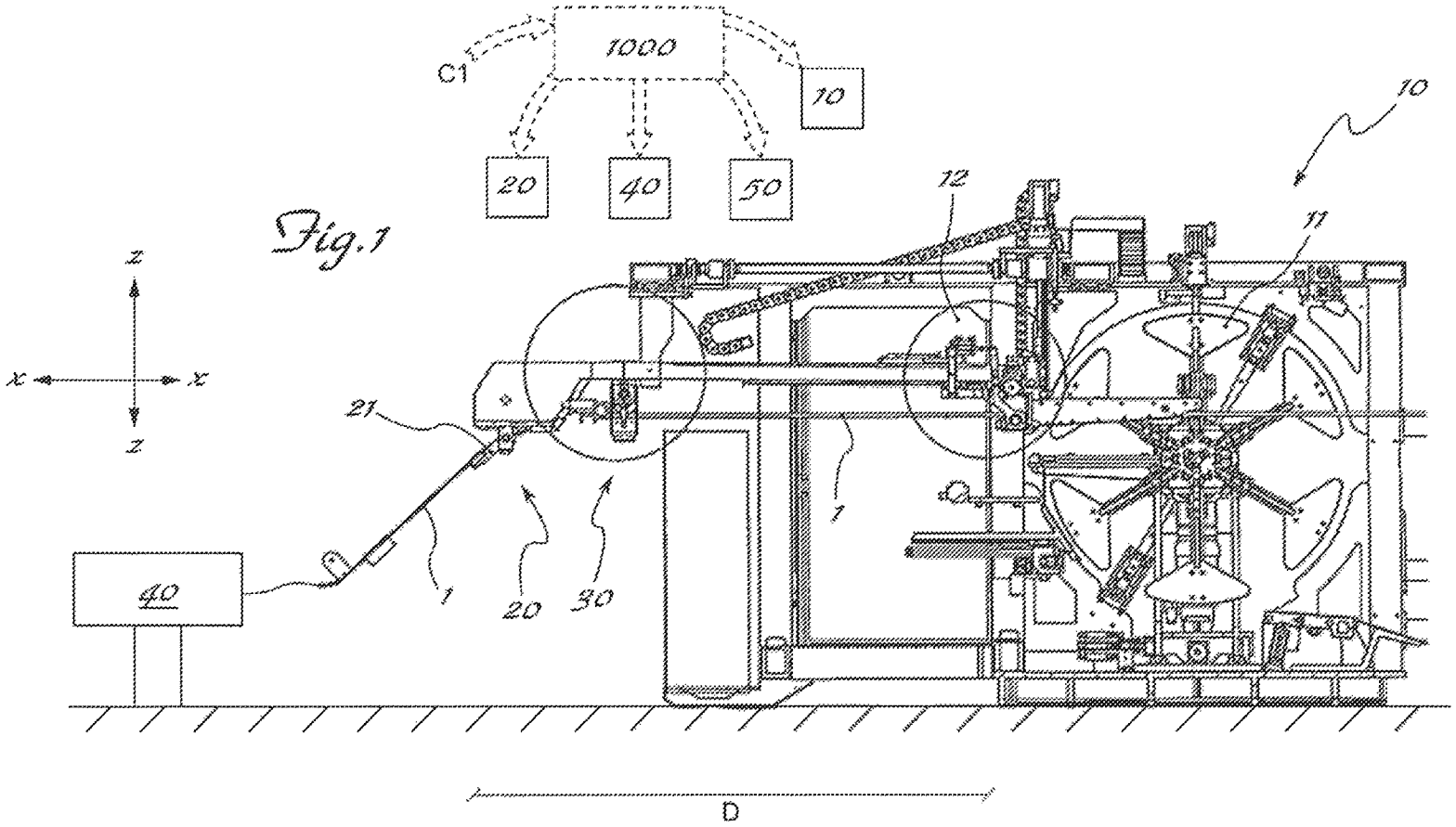
FIG. 1 shows a schematic side view of a machine for coiling pressurized pipes in spools according to the present subject matter.
Figure 2:
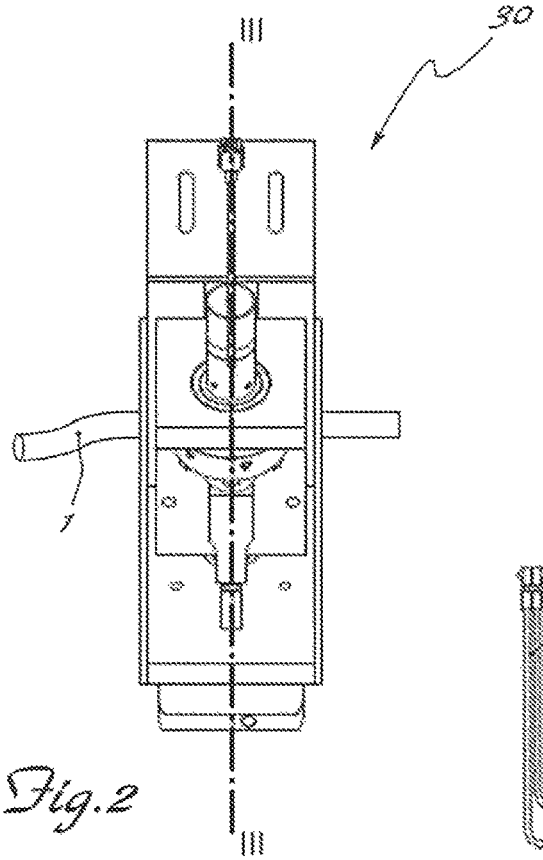
FIG. 2 shows a side view of the sealing device.
Figure 3:
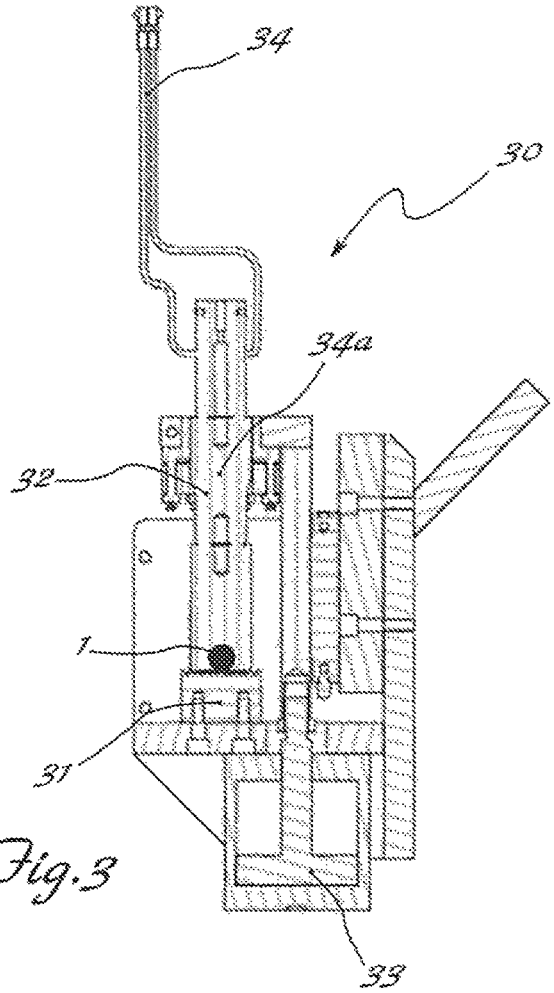
FIG. 3 shows a schematic cross-section along the plane indicated by III-III in FIG. 2.

Shown in FIG. 1 is an embodiment of a machine for coiling pipes 1 in spool form according to the present subject matter. The machine includes a supporting structure 10 having a reel 11 and a cutting device 12 fixed thereto. The reel 11 rotates about an axis perpendicular to the longitudinal direction of feeding of the pipe 1, which is in turn fed via a driving means. The cutting device 12 is mounted on the structure 10 upstream of the reel 10 and in turn operated in both senses of the vertical direction Z-Z by a corresponding electrical and/or pneumatic actuating device.

The machine further includes a measuring unit 20 arranged upstream of the cutting device 12 and at a predefined distance D from the latter. The measuring unit 20 is equipped with a meter-counting device 21, which measures the length of the pipe 1 supplied from the extrusion station and fed to the coiling machine 10. The meter-counting device emits a signal C1 when a predefined number of meters corresponding to the preset length of pipe 1 to be coiled is reached.

It is also envisaged that the sequences and the operations of the machine and the measuring unit are actuated by means of a control and command device 1000 connected to transducer means for detecting signals emitted by sensors and controlling operations which may be of an electrical, hydraulic or equivalent nature.

According to the present subject matter, it is envisaged that the machine can include a device for hermetically sealing the pipe, for example a welding gripper 30 arranged between the measuring unit 20 and the cutting device 12. According to a preferred embodiment, the welding gripper 30 includes a fixed jaw 31 and a movable jaw 32. An actuating device 33, for example of the pneumatic or electromechanical type, moves the movable jaw 32.

Preferably, a duct for transmission of ultrasounds is formed inside the movable jaw 32 and emerges at the end of the jaw making contact with the crushed pipe 1, for sealing thereof; the ultrasounds are generated by corresponding ultrasound generator means 34.

With this machine configuration it is possible to implement a method for automatically coiling in spool form pipes kept under a predefined, generally constant, internal pressure during the production cycle. The method can include:

a) starting extrusion 40 of the pipe 1—for example of the Pex-a type; and
b) feeding a first open and extruded pipe section 1 without internal pressure to the sealing unit 30;
c) sealing the head end of the first pipe section not under pressure;
d) feeding the sealed pipe 1 by an amount at least equal to the measurement of the sealed pipe section situated between the extruder 40 and the sealing gripper 30;
e) hermetically sealing the pipe section with sealed head end, following the feeding;
f) cutting the sealed extruded pipe downstream—in the direction of feeding towards the reel—of the hermetic sealing station, with formation of a pipe section having a sealed and extruded head end and a predefined internal pressure;
g) feeding the sealed head end of the extruded pipe section 1 under pressure to the coiling machine with fastening of the head end to the reel 11;
h) starting coiling with counting of the meters of coiled pipe;
i) stopping coiling when the programmed number of meters of pipe to be coiled is reached;
j) hermetically sealing the tail end of the pipe being coiled;
k) cutting the pipe downstream—in the direction of feeding—of the hermetic sealing station with formation of new sealed head end of a new section of extruded pipe under pressure;
l) completion of the spool being coiled, packaging and unloading thereof;

m) automatic conveying of the new hermetically sealed head end to the reel 11 for fastening and starting coiling of a new spool; and n) restarting the machine and the coiling cycle.

According to certain preferred modes of implementing the method it is envisaged that the first extruded pipe section, which is not under pressure and/or does not have a predefined internal pressure, is guided. In addition or alternatively, determination of the measurements of the pipe sections to be sealed and cut is performed by means of a measuring unit 20 situated between the extruder 40 and the sealing gripper 30. In addition or alternatively, the step of sealing the head ends of the pipe is performed by means of a welding gripper 30 designed to crush the head end of the pipe and seal it in order to avoid the seepage of fluid, which would result in internal pressure losses and therefore variability of the pipe dimensions.

Preferably, the welding operation is of the ultrasound type.

According to the preferred modes of implementing the method it is also envisaged that a control and command device 1000 can be connected to the coiling machine 10, to the measuring unit 20, to the welding gripper 30 and to the cutting unit 12. Control and command device 1000 can have stored thereon predefined length values of the pipe 1 to be coiled, feeding speeds of the pipe 1 fed for coiling, and the relative distance D between the measuring device and the cutting device 12. Control and command device 100 can start counting by the meter-counting device 21 for counting the meters of pipe 1 fed. Meter-counting device 21 can emit a signal C1 when a predefined number of meters corresponding to the predefined length of pipe 1 to be coiled is reached and meter-counting device 21 can send the signal C1 to the control and command device 1000. Control unit 1000 can operate sealing device, after a time interval calculated from the moment of emission of the signal C1 based on the distance D between the meter-counting device 21 and the cutting device 12 and the feeding speed of the pipe. The pipe can be cut.

As shown in FIG. 1, referred to above, and assuming solely for the sake of easier description and without any limiting meaning a pair of reference axes respectively in a longitudinal direction X-X, corresponding to the extension of the pipe 1 and the direction of feeding thereof from the outlet of an extruder 40 to the outlet of the coiling machine, and a vertical axis Z-Z corresponding to the direction of cutting of the pipe 1 to be coiled.

As a result of the method and the apparatus according to the present subject matter, it is possible to automatically perform production and coiling of pipes to be kept under a constant internal pressure during the production cycle, thus avoiding the machine downtime resulting from the need for stoppages in order to carry out manual operations. Bearing in mind that these types of machines process in a continuous cycle very large quantities of piping, the fact of being able to avoid machine stoppages for fitting the cap onto each new head end of the pipe sections to be coiled results in a considerable reduction in the machine downtime with a consequent increase in the productive efficiency of the machine. In addition, the fact of being no longer dependent on manual operations ensures that the quality of the pipe and the coiling operation is very reliable and repeatable.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." In addition, use of the term "based on," above and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations may be within the scope of the following claims.

Although described in connection with a number of embodiments and a number of preferred examples of embodiment of the present subject matter, it is understood that the scope of protection of the present patent is determined solely by the claims below.

The invention claimed is:

1. A machine for coiling pipes in spool form, the machine comprising:

a structure supporting:

a rotating reel;

a feeder for feeding a pipe to the rotating reel in a longitudinal direction;

at least one cutting device for cutting the pipe; and a measuring unit for measuring a length of the pipe, the measuring unit arranged upstream of the at least one cutting device in the longitudinal direction, and a sealing gripper for hermetically sealing the pipe, the sealing gripper situated upstream of the at least one cutting device in the longitudinal direction of feeding, wherein the sealing gripper crushes and welds an end of the pipe.

2. The machine according to claim 1, wherein the sealing gripper comprises a fixed jaw and a movable jaw moved by a pneumatic actuator or an electromechanical actuator.

3. The machine according to claim 2, wherein the sealing gripper comprises an ultrasonic welder.

4. The machine according to claim 2 wherein the movable jaw has, formed inside it, a duct for transmission of ultrasonic waves which are generated by an ultrasonic generator, wherein the ultrasonic waves reach the crushed pipe for sealing.

5. The machine according to claim 1, further comprising a control and command device connected to a transducer for detecting signals emitted by sensors and controlling operation of moving parts of the machine.

6. The machine according to claim 1, wherein the measuring unit for measuring the length of the pipe comprises:

at least one meter-counting device for measuring the length of the pipe fed to the reel in the longitudinal direction and for emitting an end-of-measurement signal.

7. The machine according to claim 6, wherein the meter-counting device sends the end-of-measurement signal to a control and command device when a predetermined number of measured meters is reached.

8. A method for automatically coiling and cutting to size a pipe with a predefined internal pressure with a coiling machine for coiling pipes in spool form, the coiling machine comprising: a structure supporting a rotating reel, at least one cutting device for cutting the pipe, a measuring unit for measuring a length of the pipe, and a sealing gripper for hermetically sealing the pipe by crushing and welding an end of the pipe;

wherein the coiling machine further comprises a feeder for feeding a pipe to the rotating reel in a longitudinal direction;

wherein the measuring unit is arranged upstream of the at least one cutting device in the longitudinal direction, and the sealing gripper is situated upstream of the at least one cutting device in the same longitudinal direction of feeding;

the method comprising:

preparing a pipe section with a sealed head end and extruded with a predefined internal pressure;

feeding the sealed head end of the extruded pipe section under pressure to the coiling machine with fastening of the head end onto the reel;

starting coiling of the fastened pipe;

stopping coiling when a desired length of pipe to be coiled is reached;

hermetically sealing a tail end of the pipe being coiled, wherein hermetical sealing of the pipe includes a crushing step and a step for welding the crushed edges of the pipe with the sealing gripper;

cutting the pipe downstream in the longitudinal direction of feeding of the hermetic sealing with formation of new sealed head end of a new pipe section extruded under pressure;

completion of the spool being coiled, packaging and unloading thereof;

automatic conveying of the new hermetically sealed head end to the rotating reel for fastening and starting coiling of a new spool; and restarting the coiling cycle.

9. The method according to claim 8, wherein the step of preparing the pipe section comprises:

feeding a first open pipe section extruded without internal pressure to the sealing gripper;

sealing the head end of the first pipe section not under pressure;

advancing the sealed pipe by an amount at least equal to the length of sealed pipe section situated between the feeder and the sealing gripper;

hermetically sealing the pipe section with sealed head end, following said advancing operation; and cutting the sealed extruded pipe downstream, in the longitudinal direction of feeding, of the hermetic sealing, with formation of a pipe section having a sealed head end and extruded with a predefined internal pressure.

10. The method according to claim 8, wherein the predefined internal pressure is a constant pressure.

11. The method according to claim 10, wherein the welding step is an ultrasonic welding step.

12. The method according to claim 8, wherein the measurements of the pipe sections to be sealed and cut are determined by the measuring unit arranged between the feeder and the sealing gripper.

13. The method according to claim 8, wherein the measuring the pipe section to be coiled comprises:

start of counting by a meter-counting device for counting meters of pipe fed;

emission by the meter-counting device of a signal when a predefined number of meters corresponding to the predefined length of pipe to be coiled is reached;

sending of the signal indicating the length has been reached to a control unit; and defining a time interval calculated from the moment of emission of the signal by the meter-counting device and determined on the basis of a distance between the measuring unit and a cutting blade and a speed of feeding of the pipe.

14. The machine according to claim 1, wherein the sealing gripper crushes and welds a head end of the pipe, the head end of the pipe being the first end of a pipe section of the pipe to be fed to the rotating reel.

* * * * *